US006616808B2

(12) United States Patent
Haga et al.

(10) Patent No.: US 6,616,808 B2
(45) Date of Patent: Sep. 9, 2003

(54) INKJET PRINTING PAPER

(75) Inventors: Katsuhiko Haga, Nagano-ken (JP); Noboru Yamada, Nagano-ken (JP); Hiroyuki Osumi, Ehime-ken (JP); Hiroyuki Ando, Ehime-ken (JP)

(73) Assignees: Seiko Epson Corporation, Tokyo (JP); Daio Paper Corporation, Ehime-Ken (JP)

( * ) Notice: Subject to any disclaimer, the term of this patent is extended or adjusted under 35 U.S.C. 154(b) by 0 days.

(21) Appl. No.: 09/971,008

(22) Filed: Oct. 5, 2001

(65) Prior Publication Data

US 2002/0088586 A1 Jul. 11, 2002

(30) Foreign Application Priority Data

Oct. 6, 2000 (JP) ..... 2000-308185
Oct. 6, 2000 (JP) ..... 2000-308186

(51) Int. Cl.[7] ..... D21H 17/63; D21H 21/14

(52) U.S. Cl. ..... 162/181.2; 162/158; 428/326; 428/323

(58) Field of Search ..... 162/158, 181.1, 162/181.2; 428/195, 211, 221, 537.5, 206, 323, 326

(56) References Cited

U.S. PATENT DOCUMENTS 5,126,010 A * 6/1992 Kobayashi et al. ..... 162/135
5,302,437 A * 4/1994 Idei et al. ..... 428/195
5,589,259 A * 12/1996 Hosoi et al. ..... 428/323
5,755,930 A * 5/1998 Satterfield et al. ..... 162/164.1
5,827,398 A * 10/1998 Depasquale et al. ..... 162/164.1
5,907,342 A * 5/1999 Sakaki et al. ..... 347/105
5,939,210 A * 8/1999 Hirose et al. ..... 428/537.5
6,335,085 B1 * 1/2002 Asano et al. ..... 428/195

* cited by examiner

*Primary Examiner*—Jose A. Fortuna
(74) *Attorney, Agent, or Firm*—McDermott, Will & Emery

(57) ABSTRACT

An inkjet printing paper of noncoated type, in which the feathering is prevented and the conveyability is improved. This inkjet printing paper comprises calcium carbonate as its filler wherein the filler contains ash of 10 to 30 weight % as defined in JIS P 8128 and wherein the paper has Stockigt sizing degree of 0.001 to 0.05 sec/g/m$^2$ according to JIS P 8122. Further, in this paper, X-ray image obtained from area-analysis with an energy-distributed X-ray microanalyzer for the surface of the inkjet printing paper, the area of white part, which indicates the presence of calcium, is 3 to 40% related to the total area of the X-ray image.

2 Claims, No Drawings

INKJET PRINTING PAPER

FIELD OF THE INVENTION

The invention relates to an inkjet printing paper of noncoated type. More particularly, the invention relates to an inkjet printing paper of noncoated type, which is produced from 100% of waste paper pulp through a paper machine.

BACKGROUND OF THE INVENTION

An inkjet printer is a unit for printing images, letters, various graphics and the like, by an inkjet printing method where small drops of ink are ejected directly against a printing paper for the attachment of the ink according to various operation principles represented by piezoelectric type, thermal type.

The inkjet printer has many advantages. This unit can be operated in high speed and quietly. With the inkjet printer, it is easy to perform multiple color printing. Further, this unit has flexibility in use of printing patterns. Additionally, the inkjet printer requires neither development nor fixing. The inkjet printer can offer images of multiple color with inks of various colors. These colors contain color materials, such as yellow, magenta, cyanogen, black, which are dissolved in solvents. Then, the inkjet printer yield images which are not less fine and not less clear than those obtained from a printing method of photoengraving or plate making. In these years, due to such advantages, the inkjet printers have quickly come into wide use.

The printing paper used for the inkjet printer is required to have the following properties. The paper of this kind should have high opacity, printing density, and white degree. Further, this paper is needed to perform vibrant coloring and absorb ink quickly. Then, on the inkjet printing paper, it is desired that ink does not run even when ink-dots are overlapped each other. It is also desired that the size of each ink-dot is controlled so as not to exceed its suitable one. Additionally, the inkjet printing papers are to be fed in an inkjet printer without any trouble such as paper jam. That is to say, the inkjet printing paper should have reliable conveyability.

Inkjet printing papers can be divided into two types, coated type and noncoated type. In order to produce each coated paper, on the surface of a pure paper, synthetic paper, synthetic resin film, or the like, a coating mixture, mainly containing filler and binder, is coated by utilizing a coater such as a blade coater and knife coater. Therefore, an ink recepter layer is formed on the coated paper. The noncoated paper is typically a pure paper and wood containing paper. The inkjet printing paper of noncoated type can be used more widely, comparing with coated type. The noncoated paper can be used for not only inkjet printers but also other kinds of printers and usual writing materials. Further, the inkjet printing paper of noncoated type has an advantage to be economical, since waste papers can be used as the material pulp. In contrast to this, the waste papers can not be used for the inkjet printing paper of coated type.

However, as for the above inkjet printing properties, a current noncoated inkjet printing paper is inferior to the coated one. Particularly when the noncoated paper is produced from the waste papers, a certain amount of waste paper pulp, which is contained in the noncoated paper, deteriorates fibers in the paper. Accordingly, the above inkjet printing properties can not be supported in the noncoated paper.

The noncoated inkjet printing paper does not have an ink recepter layer. This means that the fibers formed on the surface of the noncoated inkjet printing paper are exposed so that the paper tends to be blotted with the ink. This phenomenon is called as feathering. One drawback of the current noncoated inkjet printing paper is high tendency of this feathering. In order to prevent this phenomenon, it has been considered to increase the amount of filler for improving the smoothness of the paper. However, too many filler increases the tendency of paper powders to fall from the paper's surface. At the same time, the smoothness of the paper results in decrease of its conveyability. As a result, feathering can not be restrained effectively only by increasing the amount of filler.

SUMMARY OF THE INVENTION

It is, therefore, the first object of the present invention is to provide an inkjet printing paper of noncoated type, where inkjet printing properties are satisfied, feathering can be restrained sufficiently, and reliable conveyability is ensured. The second object of the present invention is to provide an inkjet printing paper of noncoated type, which can be produced from recycled waste papers in order to utilize resources effectively. The third object of the present invention is to provide a printing method, which allows inkjet printing paper of noncoated type to be printed without feathering and to provide a printed matter, which is obtained from such method.

According to the first aspect of the present invention, there is provided an inkjet printing paper of noncoated type produced from pulp through a paper machine, the paper comprising filler, which has calcium carbonate, wherein the paper contains ash of 10 to 30 weight % as defined in JIS P 8128 and wherein the paper has Stockigt sizing degree of 0.001 to 0.05 sec/g/m$^2$ according to JIS P 8122.

In the first aspect of the present invention, this inkjet printing paper comprises the filler, which has calcium carbonate, and the paper contains ash of 0 to 30 weight % as defined in JIS P 8128. By doing so, the above mentioned feathering can be prevented. Additionally, this inkjet printing paper has Stockigt sizing degree of 0.001 to 0.05 sec/g/m$^2$ according to JIS P 8122. This makes the paper to absorb ink very quickly whereby the ink can be dried easily on the paper. This results in that the size of each ink-dot is controlled so as not to exceed its suitable size and the ink-dots are prevented from overlapping. Accordingly, the ink does not run on this inkjet printing paper. Precisely, the preferable inkjet printing properties are given to the inkjet printing paper, which ensures clear inkjet printing. As used herein the term "Stockigt sizing degree according to JIS P 8122" refers to the value of (Stockigt sizing degree according to JIS P 8122)/(basis weight).

According to the second aspect of the present invention, there is provided an inkjet printing paper of noncoated type produced from pulp through a paper machine, the paper comprising filler, which has calcium carbonate, wherein, on X-ray image obtained from area-analysis with an energy-distributed X-ray microanalyzer for the surface of the inkjet printing paper, area of white part, which indicates the presence of calcium, is 3 to 40% related to the total area of the X-ray image.

In the second aspect of the present invention, the inkjet printing paper is produced so that on the X-ray image obtained from the area-analysis with the energy-distributed X-ray microanalyzer for the surface of the inkjet printing paper, the area of white part, which indicates the presence of calcium, is 3 to 40% related to the total area of the X-ray image. This makes the paper to absorb ink very quickly, whereby the ink can be dried easily on the paper. This results in that the size of each ink-dot is controlled so as not to exceed its suitable size and the ink-dots are prevented from overlapping. Accordingly, the ink does not run on this inkjet printing paper. Precisely, the preferable inkjet printing properties are given to the inkjet printing paper, which ensures clear inkjet printing.

The above mentioned pulp can be made from 100% of waste paper pulp. By recycling the waste papers, resources can be utilized effectively, which leads to environmental protection.

At least one side of the front and back sides of the inkjet printing paper may have the coefficient of dynamic friction of 0.3 to 0.7 measured according to JIS P 8147.

Since the inkjet printing paper has the coefficient of dynamic friction of 0.3 to 0.7, reliable conveyability can be ensured, resulting in the prevention of paper jam. In addition, by using such inkjet printing paper, a feed roller can be kept free from paper powders.

The present invention also provides a method for printing the above inkjet printing paper by e.g., pressing an ink composite-ribbon by striking pins to the paper for the attachment of the ink composite on the paper. According to this printing method, preferable printing can be performed without feathering.

The present invention also provides an inkjet method for printing the above inkjet printing paper by ejecting small drops of an ink composite directly against the paper for the attachment of the ink composite on the paper. According to this inkjet printing method, fine and clear inkjet printing can be performed.

Further, the present invention provides a printed matter which is printed by the above mentioned printing methods. On this printed matter, printing is performed finely and clearly without feathering.

DESCRIPTION OF THE PREFERRED EMBODIMENT

Now, the present invention is described more closely, referring to the preferred embodiments of the present.

As the material pulp of the inkjet printing paper according to the present invention, there are waste paper pulp; chemical pulp such as LBKP, NBKP; mechanical pulp such as GP, TMP; unlignified fiber such as kenaf, bagasse; and synthetic fiber. As the material of the waste paper, there are white woodfree shavings, white woodfree uncoated shavings, tear white shavings, used cards, publication blanks, white mechanical pulp based coated and uncoated paper, simili paper, Kent paper, white art paper, crushed news, waste magazine paper, and the like two and more than two pulps can be also used in combination as the material.

For producing the inkjet printing paper of the present invention, the material pulp can be either 100% of waste paper or virgin pulp. In both cases, the preferable inkjet printing properties and reliable conveyability can be obtained. The waste paper pulp is used preferentially, since this contributes greatly to effective utilizing of resources and environmental protection. The weight proportion in which the waste paper pulp is blended into the material pulp can be selected as desired. In particular, the waste papers having the brightness by Hunter of at least 75% are preferably used, because such material gives the printed product sharp visual contrast and a generally attractive appearance.

As the waste paper pulp, magazine waste paper pulp derived from magazine waste papers is particularly preferable. In the prior art, the magazine waste paper was believed to be unsuitable for recycling, due to the mixture of impurities such as glue applied on the backbone of each magazine, hot melt and vinyl enclosed in each magazine and the like. So, most of the magazine waste papers were disposed by incineration.

In this context, the present inventors found that almost all of impurities contained in the magazine waste papers can be removed by classification prior to this classification, the magazine waste papers are treated in deinking using a known deinking method. Then, the treated papers are classified by a known classifier and a long fiber component is removed. Next, a residual short fiber component is classified so that its pulp slurry has the Canadian standard freeness (CSF) of 240 ml to 290 ml. The resultant pulp does not suffer from the above mentioned problems caused by the impurities of the magazine waste papers, as long as the rate of blended magazine waste papers into the other kinds of waste papers is less than 50 mass %.

When the waste papers are used as the material, each obtained paper has often drawbacks such as worse touch of its surface and uneven formation. To cope with it, in the same manner as stated above, the waste papers are classified so that the long fiber component is removed and the waste paper pulp containing only the short fiber component can be used. By doing so, the preferable inkjet printing properties can be supported. Additionally, the removed long fiber component can be utilized effectively for industrial papers requiring high strength. The average length of short fibers can be optionally selected, considering the characteristics of the method for producing papers through a paper machine and considering the properties of the produced papers. Preferably, the residual short fiber component is classified so that its pulp slurry has the Canadian standard freeness (CSF) of 240 ml to 290 ml. The average length of remained short fibers is smaller than that of removed long fibers by at least 10%.

The classification of waste paper pulp may be carried out with a known classifier in a known method. In the present invention, hydraulic classification may be performed with a classifier such as Johnson Frank Shornater, Atomizing Hole, X-Kron, or the like. Mechanical classification may be also performed with a classifier such as Multi Fracter (available from Heute Co.), CH-F Screen (available from Aikawa Iron Works Co.), Fiber Crafter or the like. Among these classifiers, the Multi Fracter and CH-F Screen are particularly well-suited.

The inkjet printing paper of the present invention can be produced through any known paper machine in any known paper machine technique. The above mentioned filler may be added optionally in a suitable step in the same manner as the conventional technique.

It is most preferable that the inkjet printing paper of the present invention contains the filler, which has calcium carbonate, and the paper contains ash of 10 to 30 weight % as defined in JIS P 8128. If the amount of ash is smaller than 10 weight %, the feathering will be caused. On the other hand, if it exceeds 30 weight %, the problem associated with the falling of paper powders will be caused and such pulp is difficult to be treated in a common paper machine.

The above calcium carbonate has preferably the average particle size of 2.0 to 4.0 $\mu$m as measured by Microtrack Particle Size Distribution Meter (7995/10PC SRA model). If the average particle size is smaller than 2.0 $\mu$m, the retention of filler in the paper will be increased, which leads to high cost. On the other hand, if it exceeds 4.0 $\mu$m, the feathering can not be sustained efficiently.

It is preferable that the inkjet printing paper is produced through a paper machine so that on X-ray image obtained from arca-analysis with an energy-distributed X-ray microanalyzer (hereinafter, called as just X-ray microanalyzer) for the surface of the inkjet printing paper, area of white part, which indicates the presence of calcium, is 3 to 40% related to the total area of the X-ray image. By doing so, more preferable inkjet printing properties can be supplied. The area of white part, which indicates the presence of calcium, can be optionally adjusted in a known process with a paper machine. For this purpose, suction pressure caused by dehydration is regulated, the amount of added calcium carbonate is adjusted, the pressure of press roll is controlled, or the amount of added retention aid is adjusted.

The area-analysis with the X-ray microanalyzer is generally used for analyzing the distribution of elements. The energy-level of the element to be analyzed is set. Then, an electron beam is scanned on the surface of this sample so that the distribution of the element to be analyzed is recorded as the X-ray image of photograph. In the present invention, the element to be analyzed is calcium. The part, which indicates the presence of calcium, is recorded in the photograph as the white part. In the present invention, a known X-ray microanalyzer can be used according to a known measurement technique.

In one embodiment of the present invention, using an X-ray microanalyzer (available from Horiba Instruments Inc., EMAX 2770) with the accelerating voltage of 15 kv and the magnification of 50, the X-ray image is obtained on a black and white Polaroid print film (available from Polaroid Co., dimension of 8.5×10.8 cm). In the X-ray image, the percentage of the area of the white part, which indicates the presence of calcium, can be analyzed with a picture processing system (available from Nireco Corp., Luzex FS). This picture processing system is a unit by which, color distribution can be obtained in the area percentage shown in each photograph, printed matter and so on.

It is preferable that the inkjet printing paper of the present invention has Stockigt sizing degree of 0.001 to 0.05 sec/g/m$^2$ according to JIS P 8122. By using the inkjet printing paper having such Stockigt sizing degree, the paper absorbs ink very quickly, whereby the ink can be dried easily on the paper. This results in that the size of each ink-dot is controlled so as not to exceed its suitable size and the ink-dots are prevented from overlapping. Accordingly, the ink does not run on this inkjet printing paper. If the Stockigt sizing degree is smaller than 0.001 sec/g/m$^2$, such pulp will be difficult to be treat in a common paper machine. On the other hand, if it exceeds 0.05 sec/g/m$^2$, the paper can not absorb ink quickly, resulting that the ink stays on the printed surface. Accordingly, rub-off and set-off are caused. The desirable Stockigt sizing degree can be obtained by adjusting optionally the added amount of known size agents.

It is preferable that the surface of the inkjet printing paper has the coefficient of dynamic friction of 0.3 to 0.7. Thc coefficient of dynamic friction of the surface can be controlled so as to be in the range defined in the present invention. For this purpose, nip pressure is regulated in calendering or hot rolling. Alternatively, size press coating is carried out with water-soluble polymer such as PVA, starch or the like.

To the inkjet printing paper of the present invention, known additives may be added in its producing process. As the additives, there are ink-fixer, strengthening agent, retention aid, wet strengthening agent, dispersing agent, ultraviolet absorbent, fluorescent bleaching agent, anti-foaming agent, surfactant, cationic reagent, antistatic agent, water-holding agent and the like.

Now, the method for inkjet printing according to the present invention will be explained.

The inkjet printing method of the present invention can be applied by any conventional various types of inkjet printers and also by any conventional other kinds of printers. Concretely, the present invention offers a method for inkjet printing the above inkjet printing paper by ejecting drops of ink composite directly against the paper for the attachment of the ink composite on the paper; and a method for printing the paper by e.g., pressing an ink composite-ribbon by striking pins to the paper for the attachment of the ink composite on the paper.

The ink composite used for the inkjet printing method may comprise general coloring agents and organic solvents, which are optionally combined.

As the proper solvents used for the ink in the present invention, there are ion exchange solvent containing Ca ion of Mg ion of at most 5 ppm; and polyhydric alcohol having high boiling point and low volatility such as glycerin, ethylene glycol, triethylene glycol, propylene glycol, dipropylene glycol, hexylene glycol, polypropylene glycol, 1,3-propanediol, 1,5-pentanediol and the like. There may be also lower alkyl ether of polyhydric alcohol such as diethylene glycol monobutyl ether, triethylene glycol monobutyl ether and the like. Further, there may be organic solvent containing nitrogen such as N-methyl-2-pyrolidone, 1,3-dimethyl-2-imidazolidinone, monoethanolamine, diethanolamine, triethanolamine and the like. The additive having high hygroscopicity, e.g., urea, sugar, is preferably used for preventing the nozzles on a printing head from clogging. The amount of added polyhydric alcohol and that of added lower alkyl ether of polyhydric alcohol may be optionally determined, but 4 to 30 weight % is preferable and 7 to 20 weight % is more preferable.

According to an embodiment of the present invention, the ink composite may contain surfactant so that its permeability into the inkjet printing paper can be controlled. As the suitable surfactant, acetylene glycol can be used e.g., Surfinol 465, 420, 104 series (available from Nissin Chemical Industry Co., Ltd.).

In the present invention, the term "ink composite" means, when monochrome printing is performed, "black ink composite", while it means, when color printing is performed, "color ink composites", which includes concretely "yellow ink composite", "magenta ink composite" and "cyanogen ink composite" and which may optionally include "black ink". In addition, the inkjet printing paper according to the present invention may be used for six printing methods, which uses six different colors, respectively. These colors are derived from "yellow ink composite"; two kinds of "magenta ink composites", which are different from each other in shade; two kinds of "cyanogen ink composites", which are different from each other in shade; and "black ink composite". Generally, with these 6 colors and the inkjet printing paper of the present invention, print image with subtle color without particulate dots can be achieved. It is sure that in a region where the image has low density, particulate dots may be observed to some degree. In this case, as the magenta ink composite, its dark shade is used, and as the cyanogen ink composite, its light shade is used. This prevents the generation of particulate dots in such region, whereby the resultant print image with subtler color can be achieved. In this respect, according to a preferred embodiment of the present invention, the concentration of light shade of cyanogen ink composite is 5 to 50 weight %, and more preferably 10 to 30 weight % related to the concentration of dark shade of magenta ink composite. When thus prepared ink composites are used properly, image with subtle color can be achieved.

EXAMPLES

The coefficient of dynamic friction, feathering, ink running, and conveyability were tested in Examples and Comparative Examples. The results are shown in Table 1 and Table 2. The basis weight of inkjet printing papers in each Example and each Comparative Example was 90 g/m$^2$. The tests were carried out in the following.

[Stockigt sizing degree]: It was measured according to JIS P 8122.

[coefficient of dynamic friction]: It was measured according to "Test method of coefficient of dynamic friction for paper and paper board" defined in JIS P 8147

[feathering]: With an inkjet printer (available from Seiko Epson Corp., PM800C), in each Example and each Comparative Example, four colors of four solid lines (0.5 point, length of 10 cm) were printed, in yellow, cyanogen, magenta and black, respectively. In each line, three measurement points were set. Then, at each measurement point, the number of blots formed within the length of 1 cm was counted by visual observation. After three measurements were conducted, the average number was calculated. In Tables, mark ◎ means "the number of blots was smaller than 10 and the fathering seldom took place"; mark ○ means "the number of blots was 10 to 30 and the fathering did not take place so much"; and mark × means "the number of blots was larger than 30 and the fathering often took place"

[ink running]: An inkjet printer (available from Seiko Epson Corp., PM800C) was used under the condition of temperature of 23° C. and humidity of 50%. Then, in each Example and each Comparative Example, solid printing of red, that of green, and that of violet were performed alternately. Each color was made by mixing three primary colors (cyanogen ink; magenta ink; and yellow ink). When 30 minutes had passed after the solid printing, the ink penetration was stabled. Then, it was evaluated whether the ink running was caused or not between adjacent two printed patterns each other or from one to another. In Tables, mark ◎ means "the ink running seldom took place"; and mark × means "the ink running was observed to some degree or the ink running was observed surely".

[conveyability]:100 sheets of papers, which had been trimmed so as to have A4 size, were fed continuously into an inkjet printer (available from Seiko Epson Corp., PM800C) under the condition of temperature of 23° C. and humidity of 50%. Then, the conveyability was evaluated in each Example and Comparative Example. In Tables, mark ○ means "paper jam was not caused"; and mark × means "paper jam was caused".

TABLE 1

| | waste paper pulp (%) | ash (%) | Stockigt sizing degree (sec/g/m$^2$) | coefficient of dynamic friction | feathering | ink running | convey-ability |
|---|---|---|---|---|---|---|---|
| Ex. 1 | 100 | 10 | 0.001 | 0.4 | ○ | ◎ | ○ |
| Ex. 2 | 100 | 20 | 0.01 | 0.4 | ◎ | ◎ | ○ |
| Ex. 3 | 100 | 30 | 0.022 | 0.5 | ◎ | ◎ | ○ |
| Ex. 4 | 100 | 20 | 0.01 | 0.3 | ◎ | ◎ | ○ |
| Ex. 5 | 100 | 20 | 0.022 | 0.7 | ◎ | ◎ | ○ |
| Ex. 6 | 100 | 30 | 0.028 | 0.6 | ◎ | ◎ | ○ |
| Comp. Ex. 1 | 80 | 35 | 0.06 | 0.1 | X | X | ○ |
| Comp. Ex. 2 | 70 | 40 | 0.088 | 02 | X | X | X |
| Comp. Ex. 3 | 40 | 5 | 0.133 | 08 | X | X | ○ |
| Comp. Ex. 4 | 20 | 35 | 0.111 | 0.2 | X | X | ○ |
| Comp. Ex. 5 | 10 | 8 | 0.20 | 0.9 | X | X | ○ |

TABLE 2

| | waste paper pulp (%) | rate of area of Ca presence (%) | feathering | ink running | conveyability |
|---|---|---|---|---|---|
| Ex. 1 | 100 | 5 | ○ | ◎ | ○ |
| Ex. 2 | 100 | 20 | ◎ | ◎ | ○ |
| Ex. 3 | 100 | 40 | ◎ | ◎ | ○ |
| Ex. 4 | 100 | 30 | ◎ | ◎ | ○ |
| Ex. 5 | 100 | 10 | ◎ | ◎ | ○ |
| Ex. 6 | 100 | 3 | ◎ | ◎ | ○ |
| Comp. Ex. 1 | 80 | 2 | X | X | X |
| Comp. Ex. 2 | 70 | 45 | X | X | ○ |
| Comp. | 40 | 2 | X | X | ○ |

TABLE 2-continued

| | waste paper pulp (%) | rate of area of Ca presence (%) | feathering | ink running | conveyability |
|---|---|---|---|---|---|
| Ex. 3 | | | | | |
| Comp. Ex. 4 | 20 | 2 | X | X | ○ |
| Comp. Ex. 5 | 10 | 2 | X | X | ○ |

The results shown in Table 1 and Table 2 teaches that every Example of the present invention is superior to any Comparative Example in inkjet printing properties and conveyability.

As a result, according to the inkjet printing paper of the noncoated type of the present invention, the feathering can be sustained and superior inkjet printing properties and reliable conveyability can be obtained.

What is claimed is:

1. An inkjet printing paper of noncoated type having no ink receiving layer and produced from pulp through a paper machine, wherein said pulp consists of 100% of waste paper pulp, said paper comprises filler, which has calcium carbonate, contains ash of 10 to 30 weight % as defined in JIS P 8128, and has Stockigt sizing degree of 0.001 to 0.028 sec/g/m$^2$ according to JIS P 8122, and wherein, on an X-ray image obtained from area-analysis with an energy-distributed X-ray microanalyzer for a surface of an inkjet printing paper, area of white part, which indicates the presence of the calcium carbonate, is 3 to 40% of the total area of said X-ray image.

2. An inkjet printing paper according to claim 1, wherein at least one side of front and back sides of said inkjet printing paper has the coefficient of dynamic friction of 0.3 to 0.7 measured according to JIS P 8147.

* * * * *